US005521611A

United States Patent [19]

Okada et al.

[11] Patent Number: 5,521,611

[45] Date of Patent: May 28, 1996

[54] DRIVING CIRCUIT FOR A DISPLAY APPARATUS

[75] Inventors: Hisao Okada, Ikoma-gun; Takeshi Takarada, Tenri; Masaru Tanaka, Osaka, all of Japan

[73] Assignee: Sharp Kabushiki Kaisha, Osaka, Japan

[21] Appl. No.: 141,674

[22] Filed: Oct. 27, 1993

[30] Foreign Application Priority Data

Oct. 30, 1992 [JP] Japan ..... 4-293528

[51] Int. Cl.[6] ..... G09G 3/00

[52] U.S. Cl. ..... 345/89; 345/63; 345/77; 345/95; 345/210

[58] Field of Search ..... 345/94, 95, 77, 345/89, 147, 208, 58, 78, 79, 96, 148, 209, 92, 210, 60, 63, 76, 80, 81

[56] References Cited

U.S. PATENT DOCUMENTS

| | | | |
|---|---|---|---|
| 3,733,435 | 5/1973 | Chodil et al. | 345/60 |
| 4,201,984 | 5/1980 | Inami et al. | 345/49 |
| 4,205,903 | 6/1980 | Inami et al. | 345/105 |
| 4,228,431 | 10/1980 | Barclay et al. | 345/105 |
| 5,014,048 | 5/1991 | Knapp | 345/58 |
| 5,111,195 | 5/1992 | Fukuoka et al. | 345/94 |
| 5,159,325 | 10/1992 | Kuijk et al. | 345/208 |
| 5,196,738 | 3/1993 | Takahara et al. | 345/89 |
| 5,250,937 | 10/1993 | Kikuo et al. | 345/94 |

FOREIGN PATENT DOCUMENTS

| | | | |
|---|---|---|---|
| 0478371A2 | 4/1992 | European Pat. Off. . | |
| 478386 | 4/1992 | European Pat. Off. | 345/94 |
| 478384 | 4/1992 | European Pat. Off. | 345/208 |
| 0483972A2 | 5/1992 | European Pat. Off. . | |
| 0484159 | 5/1992 | European Pat. Off. | 345/89 |
| 488516 | 6/1992 | European Pat. Off. | 345/89 |
| 0569029 | 11/1993 | European Pat. Off. | 345/87 |
| 3-48284 | 3/1991 | Japan . | |

OTHER PUBLICATIONS

H. Okada et al., IEEE, 1991, pp. 111–114, "Development of a Low Voltage Source Driver for Large TFT–LCD System for Computer Applications".

*Primary Examiner*—Richard Hjerpe
*Assistant Examiner*—Lun-Yi Lao
*Attorney, Agent, or Firm*—Nixon & Vanderhye

[57] ABSTRACT

In the driving circuit for a display apparatus according to the present invention, a charging circuit applies a voltage equal to or higher than the highest positive gradation voltage to each data line for a predetermined period of time before the start of a period for applying a positive gradation voltage. After that, a positive gradation voltage in accordance with data is applied to each data line. Then, a period for the applying a negative gradation voltage is started, when a negative gradation voltage in accordance with data is applied to each data line. Accordingly, after being charged with a voltage applied by the charging circuit at the beginning of each cycle of the AC driving, each data line is applied with an equal or lower gradation voltage. Alternatively, a discharging circuit first applies a voltage equal to or lower than the lowest negative gradation voltage to each data line for a predetermined period of time before the start of a period for applying a negative gradation voltage. After that, a negative gradation voltage in accordance with data is applied to each data line. Then, a period for applying a positive gradation voltage is started, when a positive gradation voltage in accordance with data is applied to each data line. Accordingly, after being discharged with a voltage applied by the discharging circuit at the beginning of each cycle of the AC driving, each data line is applied with an equal or higher gradation voltage.

10 Claims, 11 Drawing Sheets

DRIVING CIRCUIT FOR A DISPLAY APPARATUS

BACKGROUND OF THE INVENTION

1. Field of the Invention

The present invention relates to a driving circuit for a display apparatus which can display an image with plural gradations by the application of voltages in accordance with digital data.

2. Description of the Related Art

FIG. 8 shows part of a conventional driving circuit for an active matrix type liquid crystal display apparatus utilizing a TFT (thin film transistor). In the following description, the display apparatus is presumed to display an image with four gradations by using two bits of data for simplification. FIG. 8 shows only a portion of the driving circuit contributing to the supply of an output $O_n$ to a data line (the nth data line).

Data $D_0$ has one bit and Data $D_1$ has one bit, which are serially sent to the driving circuit, are latched in a sampling circuit 1 by a sampling signal $T_{SMPn}$ for each data line. The data latched in the sampling circuit 1 are then latched at one time in a holding circuit 2 by a holding signal LP. A decoder 3 decodes the data latched in the holding circuit 2, thereby turning on one of four analog switches 4. As a result, one of four gradation voltages $V_0$ to $V_3$ corresponding to the data is supplied to the data line as an output $O_n$.

In a liquid crystal display, it is necessary to avoid the application of DC components for preventing the degradation of the liquid crystal as a display medium. Therefore, the driving circuit adopts AC driving. In AC driving, applied voltages are classified into several voltage levels, each having a positive or negative voltage value with a base voltage $V_M$ in the middle, as shown in FIG. 9. A positive voltage and a negative voltage are alternately inverted to each other, for example, every horizontal scanning period.

The data line receiving the output $O_n$ from the driving circuit has an equivalent circuit as shown in FIG. 10. It is necessary for the driving circuit to charge or discharge a capacitance C through a resistance R of the data line in order to apply one of the four gradation voltages $V_0$ to $V_3$ to the data line. In FIG. 10, resistance components and capacitance components, which are inherently present in a data line as distributed constants, are equivalently indicated as the resistance R and the capacitance C as lumped elements. Although the data line is further connected to a pixel capacitance $C_{LC}$ via a TFT as shown in FIG. 10, the pixel capacitance $C_{LC}$ can be ignored because it has a smaller capacitance by equal to or more than three orders of magnitude than the capacitance C.

When the driving circuit supplies, for example, a gradation voltage $V_0$ to the data line, as shown in FIG. 11, a voltage of $+V_0$ is applied to the data line in a scanning period $T_1$ to charge the capacitance C, and a voltage of $-V_0$ is applied to the data line in a scanning period $T_2$ to discharge the capacitance C. In this manner, charge and discharge of the capacitance C are alternately repeated in each horizontal scanning period. When the gradation voltage is switched from $V_0$ to $V_3$, a voltage of $+V_0$ is applied to the data line in the period $T_1$, and then a voltage of $-V_3$ is applied to the data line in the period $T_2$ as shown in FIG. 12. When the gradation voltage is switched from $V_3$ to $V_0$, a voltage of $+V_3$ is applied to the data line in the period $T_1$, and then a voltage of $-V_0$ is applied to the data line in the period $T_2$ as shown in FIG. 13. In this manner, it is necessary to charge or discharge the capacitance C in accordance with the data supplied to the driving circuit.

In such a driving circuit, the difference between the highest voltage $+V_0$ of the positive gradation voltages and the lowest voltage $-V_0$ of the negative gradation voltages is taken as, for example, 10 V, and the resistance of one data line is taken as, for example, 50 kΩ. Under such conditions, the driving circuit of FIG. 8 supplies a charging/discharging current of 0.2 mA (10 V/50 kΩ) at most. For example, in an RGB display panel having 640 pixels in the horizontal direction, however, the number of the data lines are actually 1920 (640×3), and therefore, a driving circuit in such a display panel supplies a maximum charging/discharging current of 384 mA (0.2 mA×1920) as a whole.

Therefore, in a conventional driving circuit, it is necessary for the power supply circuits for the gradation voltages $V_0$ to $V_3$ to supply a large charging/discharging current by using, as output means of a negative feedback circuit of an operational amplifier 11, a SEPP (single ended push-pull) circuit comprising a complementary symmetry npn transistor 12 and pnp transistor 13, as shown in FIG. 14. Moreover, the analog switches 4 should be bidirectional.

Because of the above, the structures of the power supply circuits and the like are complicated in the conventional driving circuit. As a result, the production cost is raised and a larger electric power is required.

SUMMARY OF THE INVENTION

In one aspect of the present invention, the driving circuit of this invention is used for a display apparatus in which a positive voltage and a negative voltage selected from a plurality of gradation voltages in accordance with data are alternately applied to a display medium through each data line. The driving circuit comprises charging means for applying a voltage equal to or higher than a highest positive gradation voltage to each data line for a predetermined period of time at the beginning of a period for applying a positive gradation voltage.

Alternatively, the driving circuit of this invention comprises discharging means for applying a voltage equal to or lower than a lowest negative gradation voltage to each data line for a predetermined period of time at the beginning of a period for applying a negative gradation voltage.

In another aspect of the present invention, the driving circuit is used for a display apparatus in which a positive voltage and a negative voltage selected from a plurality of gradation voltages in accordance with data are alternately applied to a display medium through each data line for each alternate frame. The driving circuit comprises charging means for applying a voltage equal to or higher than a highest positive gradation voltage to each data line for a predetermined period of time at the beginning of a horizontal scanning period.

In one embodiment of this invention, a voltage equal to or higher than the highest positive gradation voltage is applied to each data line for the predetermined period in a negative frame, and a voltage equal to or higher than a highest negative gradation voltage is applied to each data line for the predetermined period in a negative frame.

Alternatively, the driving circuit of this invention comprises discharging means for applying a voltage equal to or lower than a lowest negative gradation voltage to each data line for a predetermined period of time at the beginning of a horizontal scanning period.

In one embodiment of the present invention, a voltage equal to or lower than a lowest positive gradation voltage is applied to each data line for the predetermined period in a positive frame, and a voltage equal to or lower than the lowest negative gradation voltage is applied to each data line for the predetermined period in a negative frame.

In another embodiment of the present invention, a power supply circuit for the highest positive gradation voltage works also as a power supply circuit for the charging means.

In still another embodiment of the present invention, a power supply circuit for the lowest negative gradation voltage works also as a power supply circuit for the discharging means.

In the driving circuit for a display apparatus according to the present invention, charging means applies a voltage equal to or higher than the highest positive gradation voltage to each data line for a predetermined period of time before the start of a period for applying a positive gradation voltage. After that, a positive gradation voltage in accordance with data is applied to each data line. Then, a period for applying a negative gradation voltage is started, when a negative gradation voltage in accordance with data is applied to each data line. Accordingly, after being charged with a voltage applied by the charging means at the beginning of each cycle of the AC driving, each data line is applied with an equal or lower gradation voltage. In other words, the data line is discharged alone to follow the applied voltage.

In another aspect of the driving circuit for a display apparatus of this invention, discharging means first applies a voltage equal to or lower than the lowest negative gradation voltage to each data line for a predetermined period of time before the start of a period for applying a negative gradation voltage. After that, a negative gradation voltage in accordance with data is applied to each data line. Then, a period for applying a positive gradation voltage is started, when a positive gradation voltage in accordance with data is applied to each data line. Accordingly, after being discharged with a voltage applied by the discharging means at the beginning of each cycle of AC driving, each data line is applied with an equal or higher gradation voltage. In other words, the data line is charged alone to follow the applied voltage.

As a result, the power supply circuit for the charging means or the discharging means of the present invention can be an unidirectional circuit for either charging or discharging alone. The power supply circuits for the gradation voltages can also be unidirectional circuits for either discharging or charging alone, reversely to that for the charging or discharging means.

Moreover, the power supply circuit for the highest positive gradation voltage can work also as the power supply circuit for the charging means. The power supply circuit for the lowest negative gradation voltage can work also as the power supply circuit for the discharging means.

Thus, the invention described herein makes possible the advantages of providing an inexpensive driving circuit for a display apparatus which requires a small amount of electric power.

These and other advantages of the present invention will become apparent to those skilled in the art upon reading and understanding the following detailed description with reference to the accompanying figures.

DESCRIPTION OF THE PREFERRED EMBODIMENTS

The present invention will now be described by way of examples referring to the accompanying drawings.

(EXAMPLE 1)

In this example, a driving circuit for an active matrix type liquid crystal display apparatus utilizing a TFT will be described. In the following description, the display apparatus is presumed to display an image with four gradations by using two bits of data for simplification.

Figure 1:
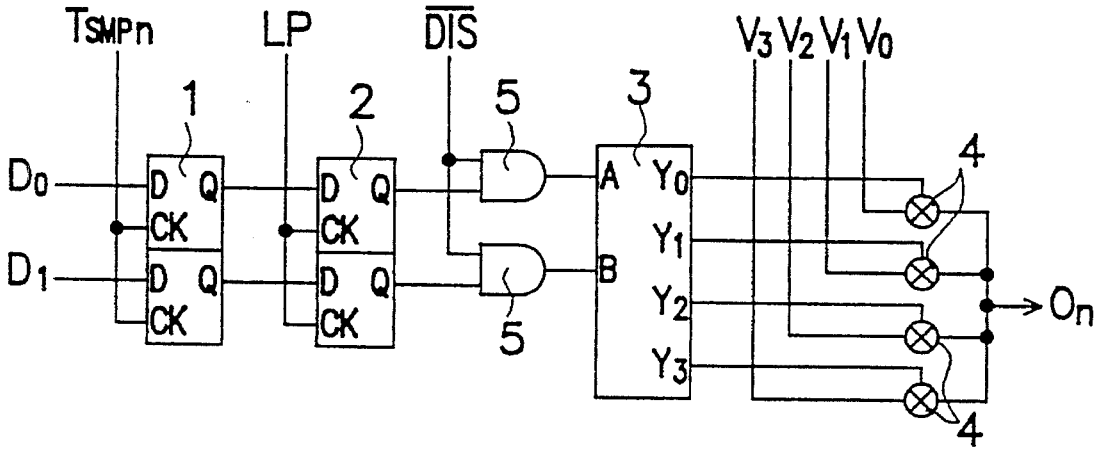
FIG. 1 is a block diagram of a driving circuit for a display apparatus according to an example of the present invention.
Figure 8:
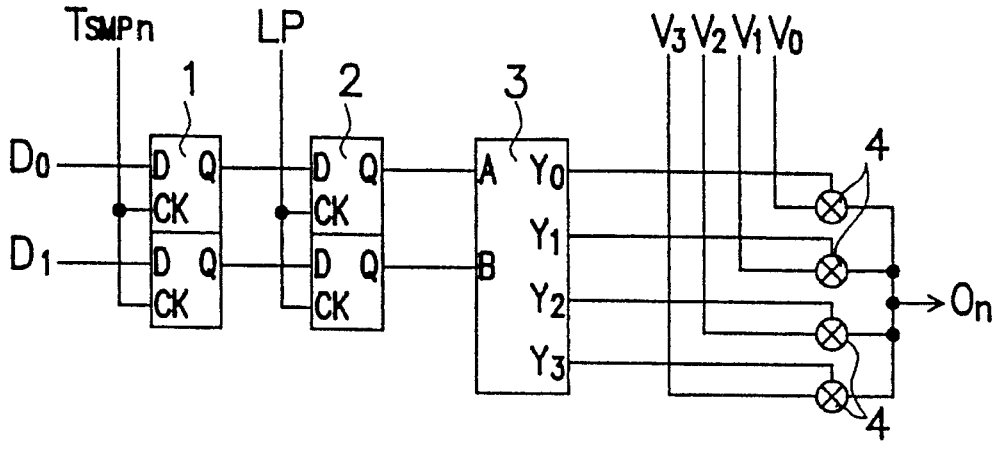
Fig. 8 (PRIOR ART)
FIG. 8 is a block diagram of a conventional driving circuit for a display apparatus.
Figure 9:
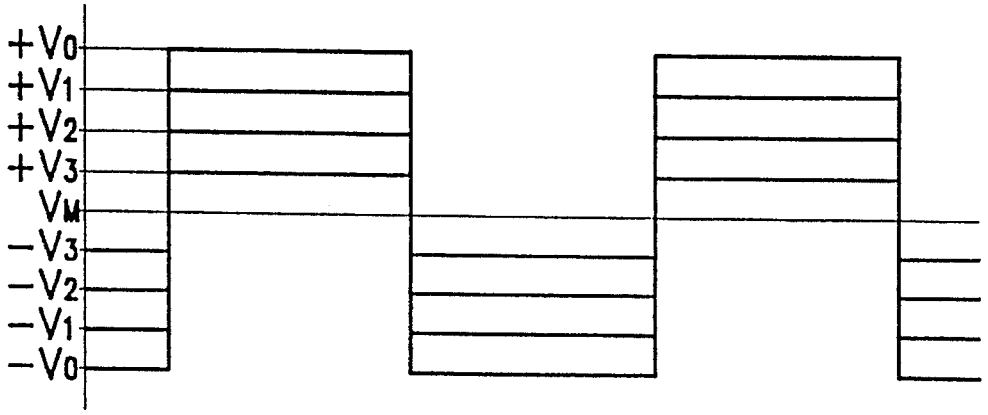
Fig. 9 (PRIOR ART)
FIG. 9 is a time chart for a typical operation of the driving circuit of FIG. 8.
Figure 10:
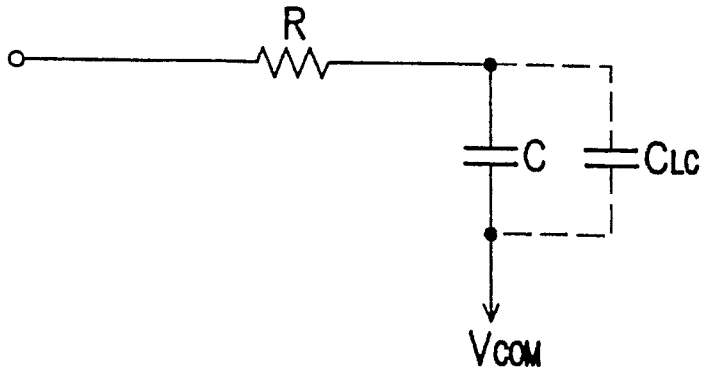
Fig. 10 (PRIOR ART)
FIG. 10 is an equivalent circuit for a data line.
Figure 11:
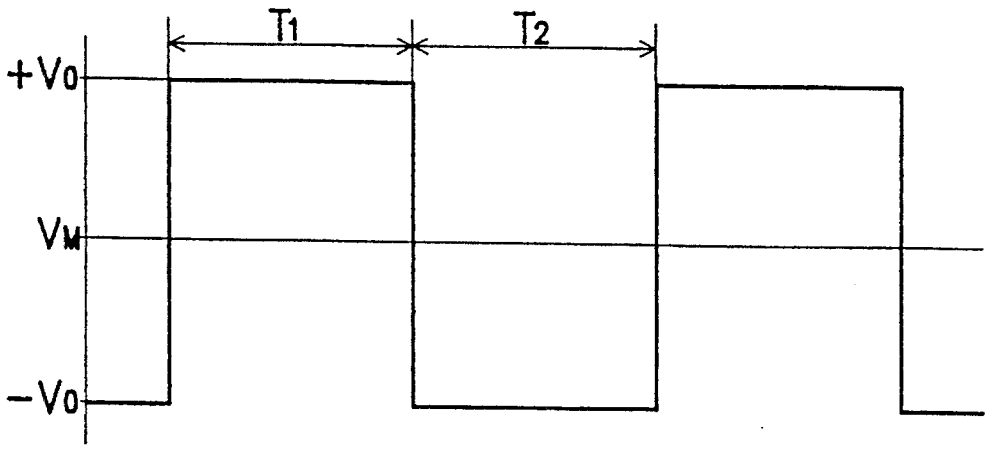
Fig. 11 (PRIOR ART)
FIG. 11 is a time chart for an operation of the conventional driving circuit of FIG. 8 outputting a gradation voltage $V_0$.
Figure 12:
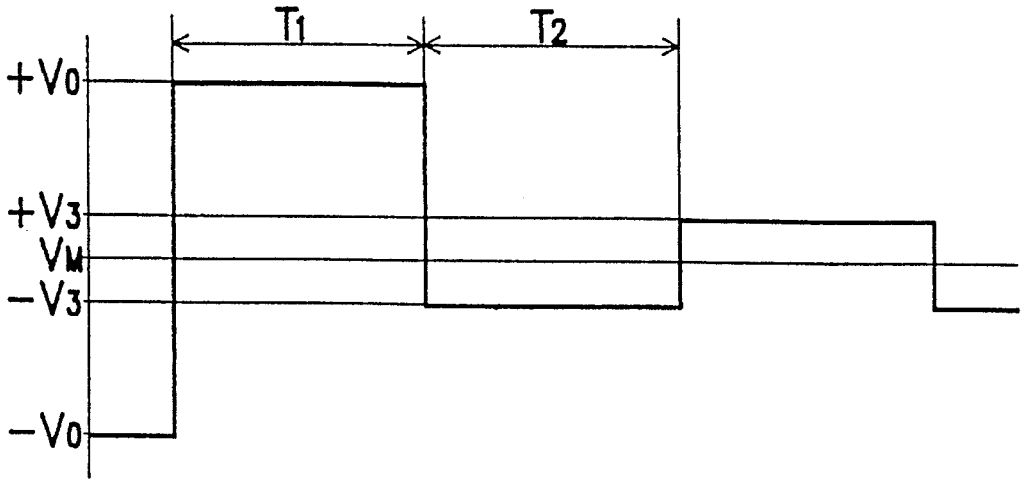
Fig. 12 (PRIOR ART)
FIG. 12 is a time chart for another operation of the conventional driving circuit of FIG. 8 switching the gradation voltage from $V_0$ to $V_3$.
Figure 13:
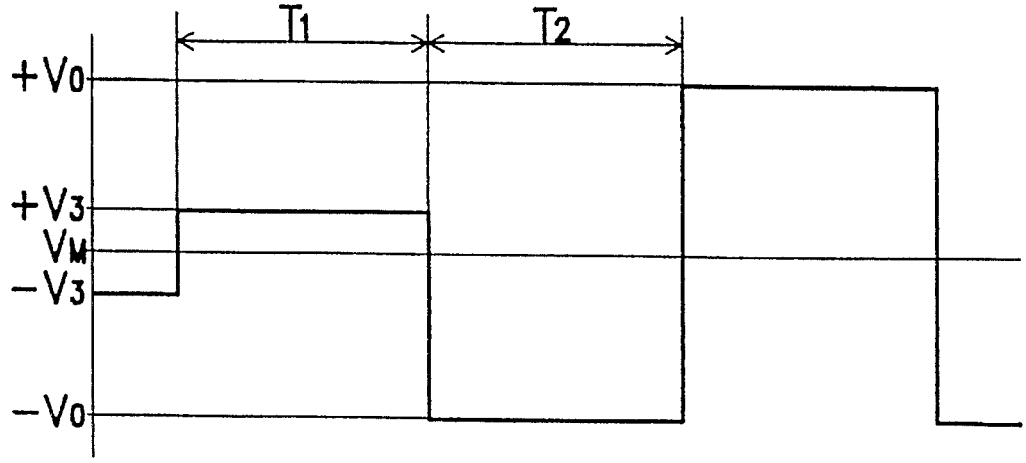
Fig. 13 (PRIOR ART)
FIG. 13 is a time chart for another operation of the conventional driving circuit of FIG. 8 switching the gradation voltage from $V_3$ to $V_0$.
Figure 14:
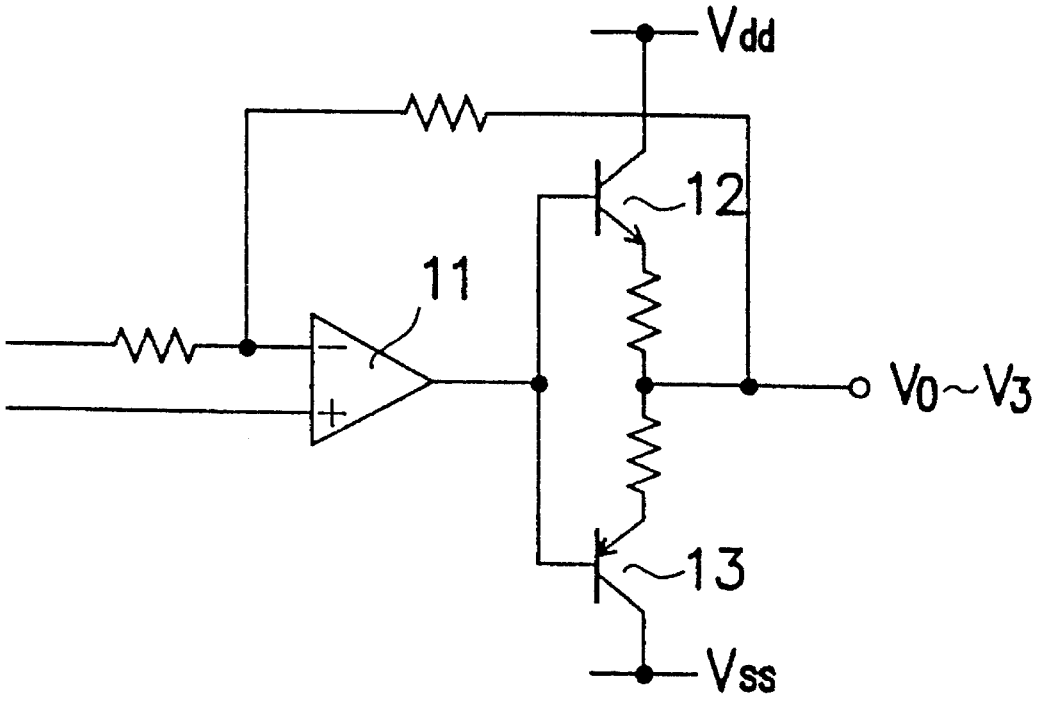
Fig. 14 (PRIOR ART)
FIG. 14 is a block diagram of a conventional power supply circuit.

FIG. 1 is a block diagram of the driving circuit for a display apparatus of this example. FIG. 1 shows only a portion of the driving circuit distributing the supply of an output $O_n$ to a data line (the nth data line). Like reference numerals will be used throughout to refer to like elements in the conventional circuits shown in FIGS. 8 and 14.

The driving circuit comprises a sampling circuit 1, a holding circuit 2, AND circuits 5, a decoder 3 and analog switches 4. The sampling circuit 1 is a flip-flop circuit for latching two bits of data $D_0$ and $D_1$ by a sampling signal $T_{SMPn}$. The holding circuit 2 is a flip-flop circuit for latching the two bits of data $D_0$ and $D_1$ latched in the sampling circuit 1 by a holding signal LP. The AND circuit 5 is a gate circuit for transferring the data $D_0$ or $D_1$ latched in the holding circuit 2 to the decoder 3. Data $D_0$ and $D_1$ are only transferred to the decoder 3 when a charging/discharging signal $\overline{DIS}$ is at a high level. When the charging/discharging signal $\overline{DIS}$ is at a low level, then the signals input to the terminals AB of decoder 3 are both caused to be at a low level regardless of the value of data $D_0$ and $D_1$ input to AND circuit 5. At the low level period of the $\overline{DIS}$ signal, the circuit is activated for charging/discharging the data line.

The decoder 3 receives two bits of signals to activate one of the four output lines $Y_0$ to $Y_3$ in accordance with the values of the received signals. The four output lines $Y_0$ to $Y_3$ are connected to the control input terminals of the four analog switches 4, respectively. The analog switch 4 is a contactless switching circuit connected between one of the gradation voltages $V_0$ to $V_3$ and the output $O_n$ of the driving circuit. Only one of the analog switches 4 is selected by the decoder 3 to be turned on, thereby connecting one of the gradation voltages $V_0$ to $V_3$ to the output $O_n$. In other words, when the terminals A and B of the decoder 3 are both supplied with signals at a low level, the gradation voltage $V_0$ is output. When the terminals A and B of the decoder 3 are both supplied with signals at a high level, the gradation voltage $V_3$ is output. The output $O_n$ of the driving circuit is supplied to the corresponding one of the data lines of the display apparatus.

The operation of the driving circuit having the above-mentioned structure will be described referring to the time charts shown in FIGS. 2 and 3. In this example, a common electrode of the display apparatus, which faces a plurality of pixel electrodes connected to the data lines with a liquid crystal layer as a display medium interposed therebetween, adopts DC driving at a base voltage $V_M$.

Figure 2:
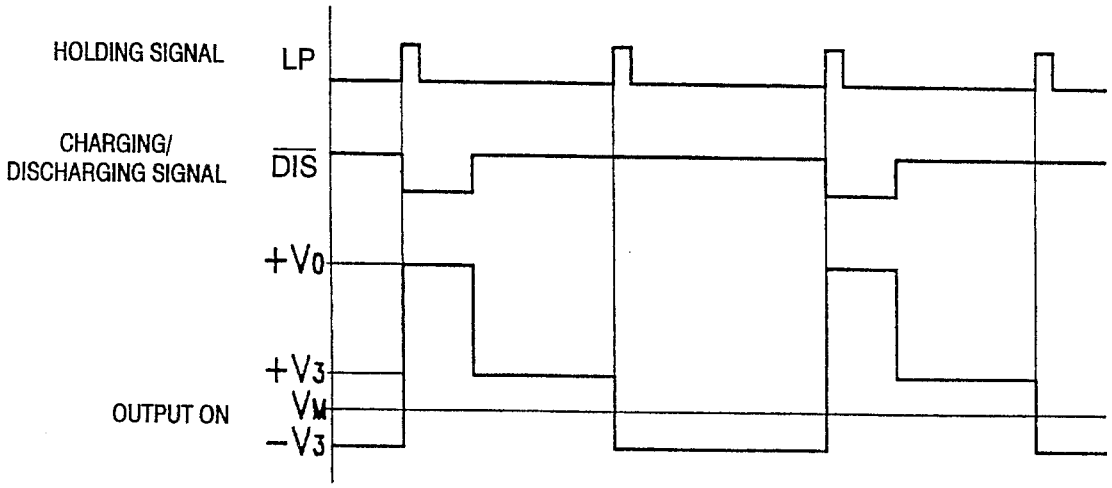
FIG. 2 is a time chart for an operation of the driving circuit of FIG. 1.
Figure 3:
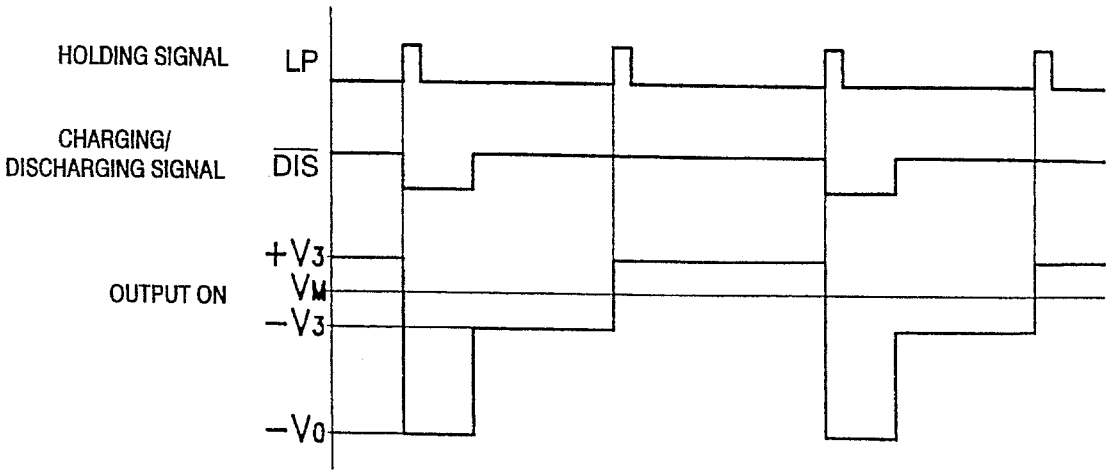
FIG. 3 is a time chart for another operation of the driving circuit of FIG. 1.

A holding signal LP has a pulse in each horizontal scanning period as shown in FIG. 2. The data $D_0$ and $D_1$ are latched in the holding circuit 2 at the timing of the pulse. Since the driving circuit adopts AC driving, the gradation voltages $V_0$ to $V_3$ are inverted between a negative voltage level and a positive voltage level in each horizontal scanning period. Therefore, when the data $D_0$ and $D_1$ corresponding to the gradation voltage $V_3$ are input as shown in FIG. 2, gradation voltages of $+V_3$ and $-V_3$ are alternately output in each horizontal scanning period. The sampling signal $T_{SMPn}$ (not shown) has a pulse at an appropriate timing in each horizontal scanning period, thereby latching, in the sampling circuit 1, only the corresponding data among all the two bits of data serially transferred to the driving circuit.

A charging/discharging signal $\overline{DIS}$ is activated for a predetermined period of time after the start of the output of the gradation voltage $+V_3$. Therefore, the driving circuit once outputs a voltage of $+V_0$, i.e., the highest voltage, at the beginning of the application of the positive gradation voltage, then outputs a voltage of $+V_3$ in accordance with the data $D_0$ and $D_1$, and finally outputs a voltage of $-V_3$ when a negative gradation voltage is being applied. This cycle is repeated every two horizontal scanning periods, i.e., every cycle of AC driving.

As a result, in the driving circuit of this example, the data line is always discharged regardless of the data $D_0$ and $D_1$ after being charged up to the highest voltage of $+V_0$ at the beginning of one cycle of AC driving. Therefore, when the power supply circuit for the gradation voltage $V_0$ alone is bidirectional, the power supply circuits for the other gradation voltages $V_1$ to $V_3$ can be unidirectional circuits used for only discharging.

When the charging/discharging signal $\overline{DIS}$ is activated for a predetermined period of time after the start of the output of the gradation voltage $-V_3$, the data line is always charged regardless of the data $D_0$ and $D_1$ after being discharged down to the lowest voltage of $-V_0$ at the beginning of one cycle of the AC driving. Therefore, when the power supply circuit for the gradation voltage $V_0$ alone is bidirectional, the power supply circuits for the other gradation voltages $V_1$ to $V_3$ can be unidirectional circuits used for only charging.

Figure 4:
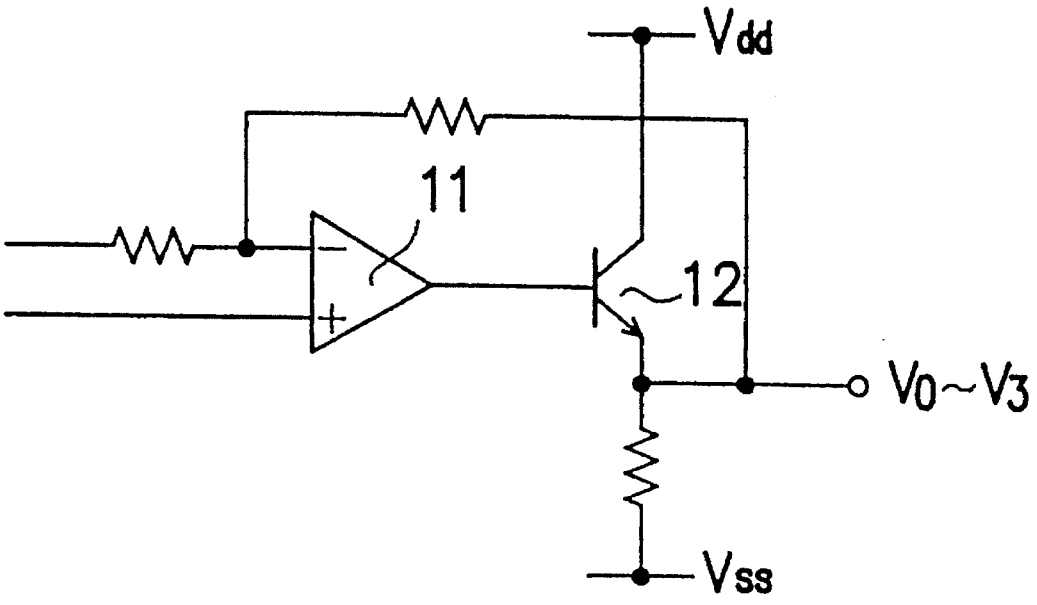
FIG. 4 is a block diagram of a power supply circuit according to an example of the present invention.

FIG. 4 is a block diagram of a unidirectional power supply circuit, for example, for charging alone. The power supply circuit has such a simple structure that the output means for a negative feedback circuit of an operational amplifier 11 comprises an npn transistor 12 alone as shown in FIG. 4.

Figure 5:
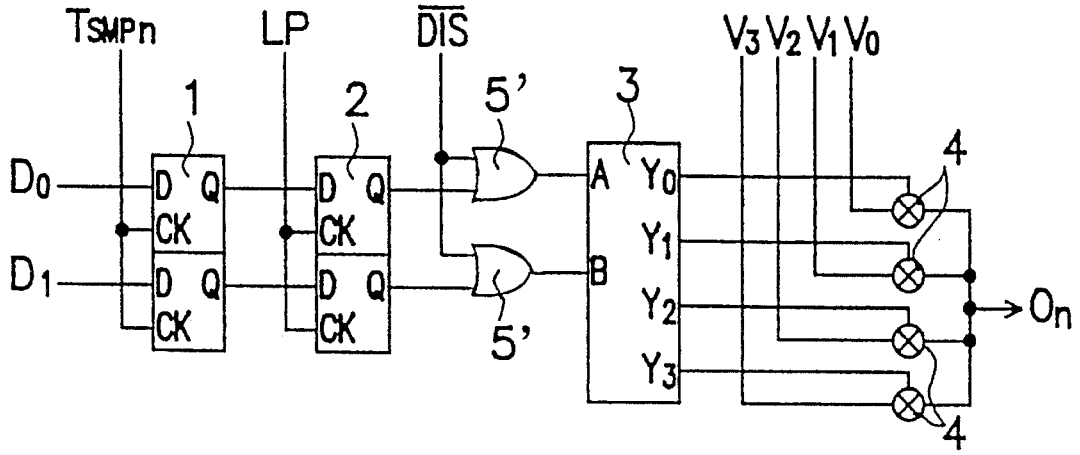
FIG. 5 is a block diagram of a driving circuit for a display apparatus according to another example of the present invention.

The AND circuits 5 can be replaced with OR circuits 5' to form a gate circuit as shown in FIG. 5.

Moreover, in this example, a power supply circuit for the highest positive gradation voltage $+V_0$ also works as a power supply circuit for charging. A power supply circuit for the lowest negative gradation voltage $-V_0$ also works as a power supply circuit for discharging. Since one power supply circuit is used for double purposes, the whole driving device can be made more compact. The power supply circuits for charging and discharging, however, can be provided separately from those for the gradation voltages.

(EXAMPLE 2)

Figure 6:
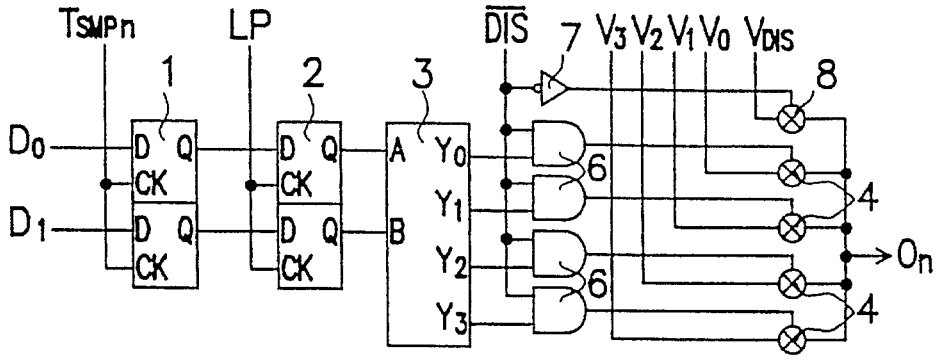
FIG. 6 is a block diagram of a driving circuit for a display apparatus according to still another example of the present invention.

FIG. 6 is a block diagram of a driving circuit for a display apparatus according to this example. Explanation for like elements in Example 1 will be partially omitted in the following description.

The driving circuit comprises, as shown in FIG. 6, a sampling circuit 1, a holding circuit 2, a decoder 3, AND circuits 6, a NOT circuit 7, analog switches 4 and another analog switch 8. The four output lines $Y_0$ to $Y_3$ of the decoder 3 are connected to the control input terminals of the four analog switches 4 via the four AND circuits 6, respectively. The AND circuit 6 is a gate circuit which makes the output lines $Y_0$ to $Y_3$ of the decoder 3 effective only when the charging/discharging signal $\overline{DIS}$ is deactivated (at a high level). The analog switch 8 is connected between a power supply circuit for a voltage $V_{DIS}$ and the output $O_n$ of the driving circuit, and receives charging/discharging signal $\overline{DIS}$ through its control terminal via the NOT circuit 7. The voltage $V_{DIS}$ is adjusted to have a lower voltage level than that of the lowest negative gradation voltage $-V_0$.

Figure 7:
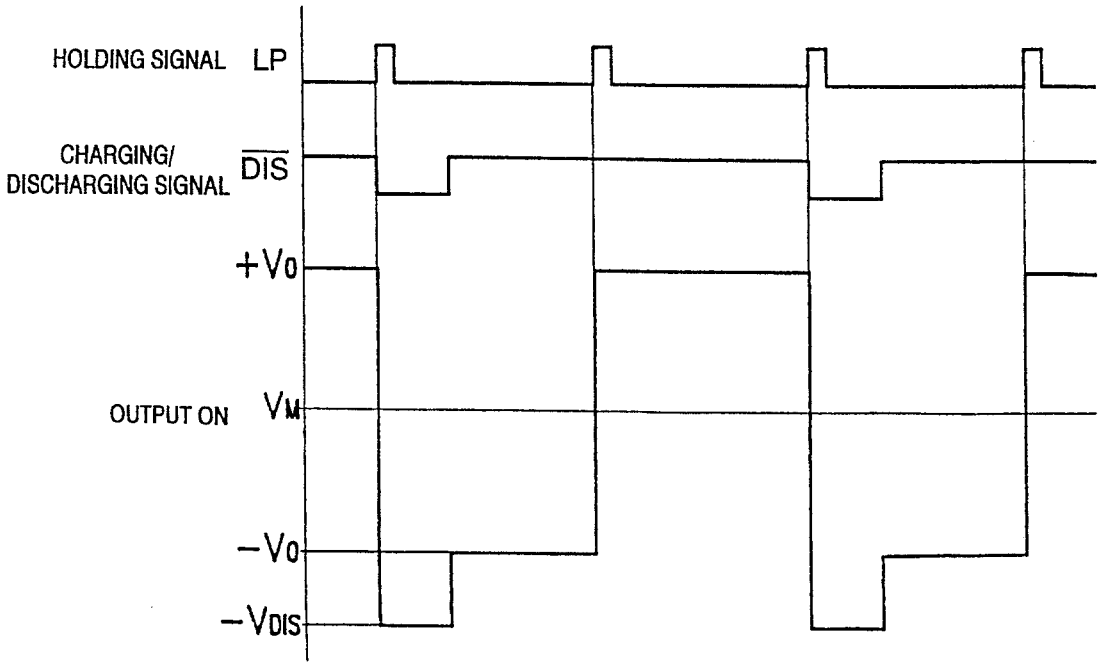
FIG. 7 is a time chart for the driving circuit of FIG. 6.

FIG. 7 is a time chart for an operation of the driving circuit of this example. As shown in FIG. 7, when the charging/discharging signal $\overline{DIS}$ is activated for a predetermined period of time after the start of the output of the negative gradation voltage, the data line is always charged regardless of the data $D_0$ and $D_1$ after being discharged down to the lowest voltage $-V_{DIS}$ at the beginning of one cycle of the AC driving. Therefore, the power supply circuit for the voltage $V_{DIS}$ can be a unidirectional circuit for discharging alone, while the power supply circuits for all the gradation voltages $V_0$ to $V_3$ can be unidirectional circuits for charging alone.

As described above, in the examples of the present invention, all the power supply circuits for the gradation voltages can be unidirectional circuits to simplify the circuit configuration, resulting in a lower production cost of the driving circuit. Moreover, since the power supply circuit is unidirectional, the number of the output transistors therein can be halved, thereby decreasing the electric power consumed in the driving circuit. In addition, the analog switch 4 can be unidirectional to further simplify the driving circuit, resulting in a more compact LSI.

Although the display with four gradations by two bits of data is described in the above-mentioned examples, the driving circuit of the present invention can be applied in a case where a display with eight or more gradations by three or more bits of data is desired. In such a case, since the number of the power supply circuits for each gradation is further increased, the power supply circuits are further effectively simplified.

The present invention is not limited to the cases where a common electrode adopts DC driving, but can be applied in a case where a common electrode adopts AC driving. In such a case, AC driving for a driving circuit means that a positive and negative voltage of a data line with respect to a voltage level of a common electrode are alternately inverted to each other.

There is another driving method for a display apparatus. In the driving method, the gradation voltages are inverted between a negative voltage level and a positive voltage level for each alternate frame. In such a case, the polarity of the gradation voltages to be applied to a display medium is not inverted during each frame, but the voltage level of the gradation voltage to be applied to the display medium is varied for each horizontal scanning period. Thus, in the conventional driving circuit, it is necessary for the power supply circuits for the gradation voltages supply a charging/discharging current.

Figure 15:
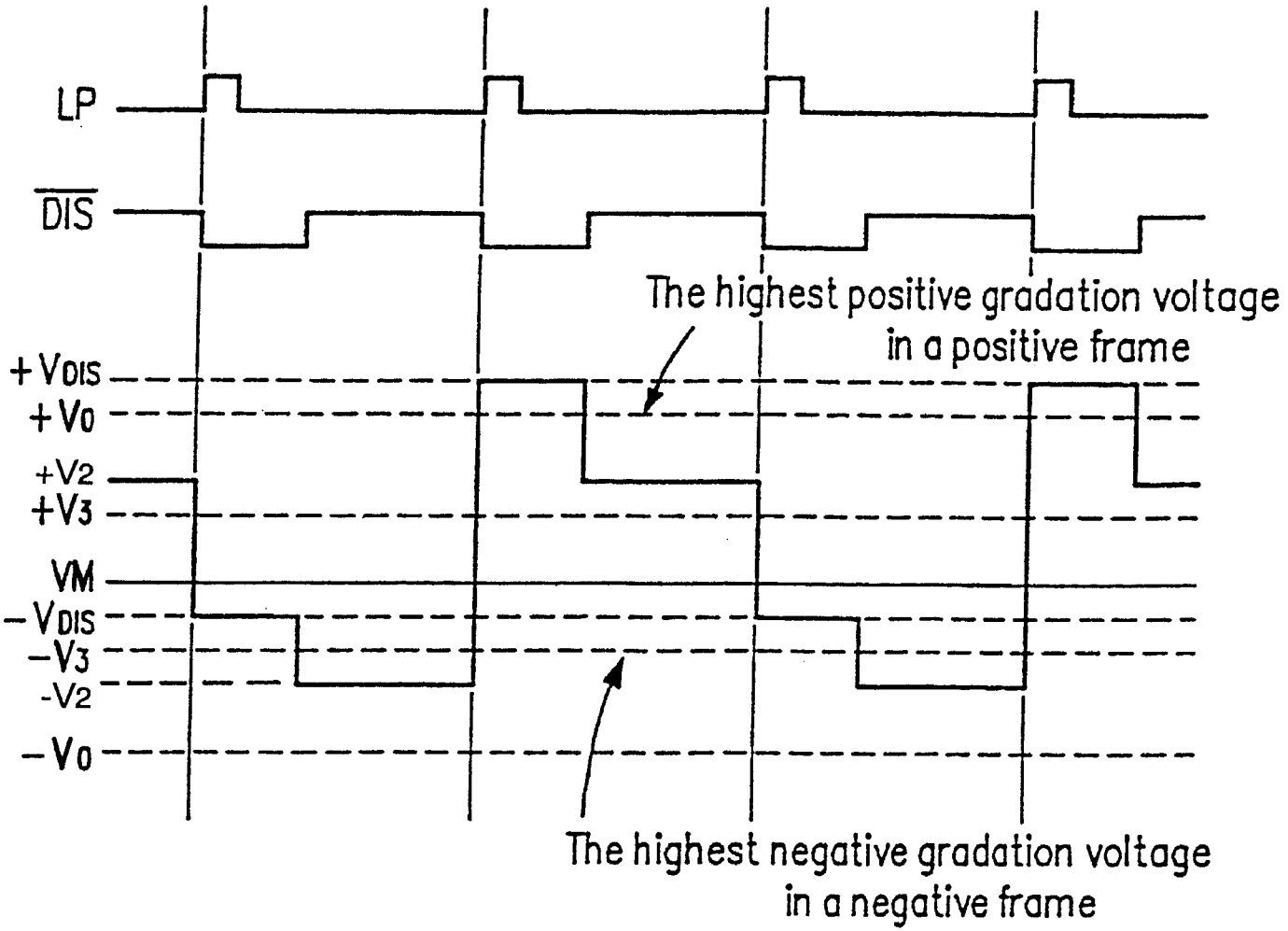
FIG. 15 is a time chart for another driving method wherein a voltage equal to or higher than the highest positive gradation voltage is applied to each data line for a predetermined period.
Figure 16:
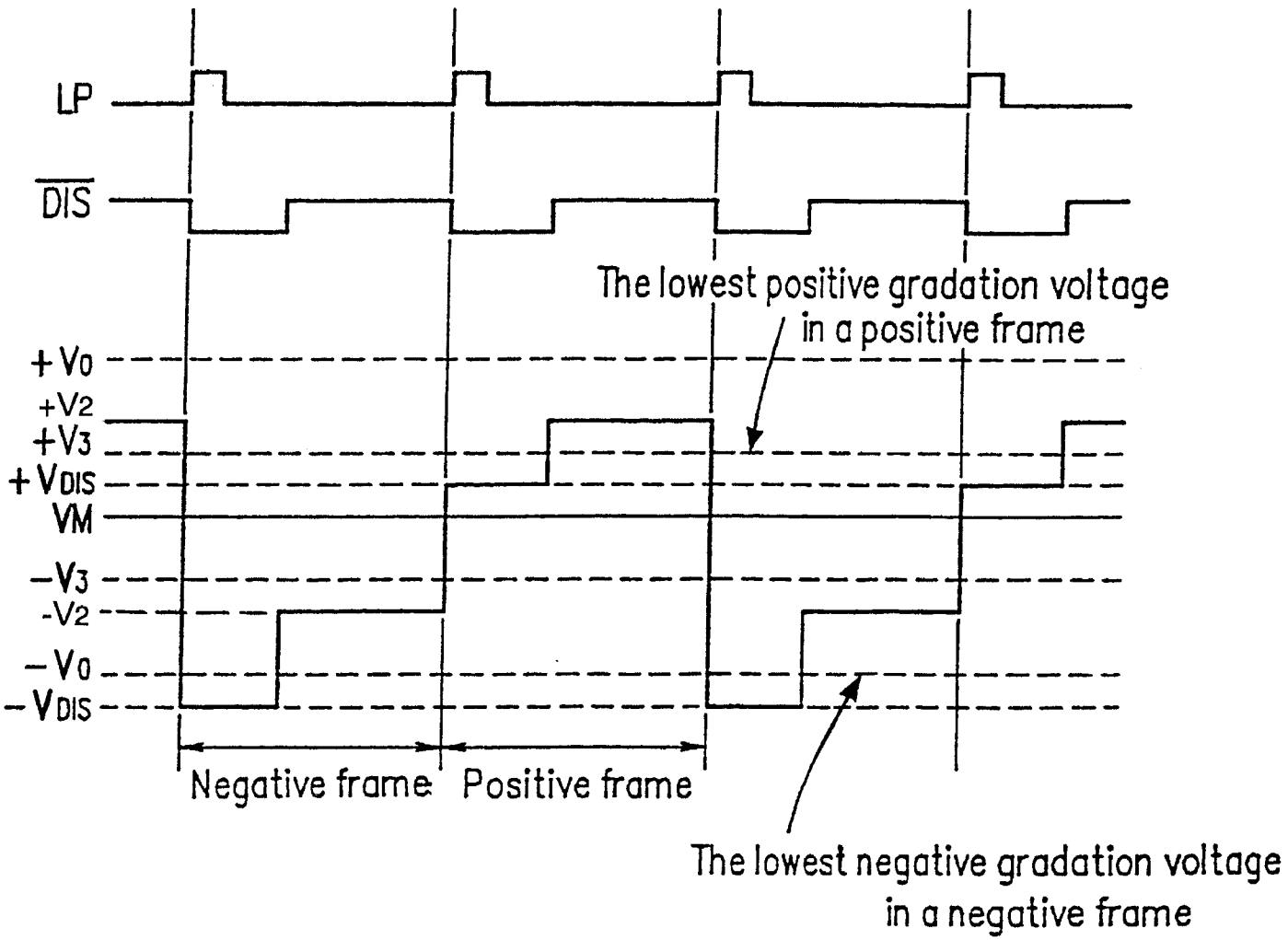
FIG. 16 is a time chart for another driving method wherein a voltage equal to or lower than the lowest negative gradation voltage is applied to each data line for a predetermined period.

In one application of the present invention for such a case, as illustrated in FIG. 15 either a voltage $+V_{DIS}$ equal to or higher than the highest positive gradation voltage, or as illustrated in FIG. 16 a voltage $V_{DIS}$ equal to or lower than the lowest negative gradation voltage is applied to the display medium through each data line for a predetermined period of time at the beginning of each horizontal scanning period. Thus, the power supply circuits for the gradation voltages can be unidirectional circuits for either discharging or charging alone.

Preferably, in view of consumption of electric power, when the power supply circuits for the gradation voltages are for discharging alone (as, for example, in FIG. 15), a voltage ($+V_{DIS}$) equal to or higher than the highest positive gradation voltage ($+V_0$) is used for charging in a positive frame, and a voltage ($-V_{DIS}$) equal to or higher than the highest negative gradation voltage ($-V_3$) is used for charging in a negative frame. When the power supply circuits for the gradation voltages are for charging alone (as, for example, in FIG. 16), a voltage ($+V_{DIS}$) equal to or lower than the lowest positive gradation voltage ($+V_3$) is used for discharging in a positive frame, and a voltage ($-V_{DIS}$) equal to or lower than the lowest negative gradation voltage ($-V_0$) is used for discharging in a negative frame. Here, the highest negative gradation voltage and the lowest negative gradation voltage each indicate a voltage at which the difference between the voltage level of a common electrode and that of a pixel electrode is minimum.

The present invention is not limited to a driving circuit for an active matrix LCD using a TFT as described in the above examples, but can be applied in driving circuits for other display apparatuses which conduct a gradation display by the application of voltages in accordance with digital data, such as an EL (electroluminescence) display apparatus and a plasma display.

Various other modifications will be apparent to and can be readily made by those skilled in the art without departing from the scope and spirit of this invention. Accordingly, it is not intended that the scope of the claims appended hereto be limited to the description as set forth herein, but rather that the claims be broadly construed.

What is claimed is:

1. A driving circuit for a display apparatus having a gradation display operable by voltages applied in accordance with digital data in which a positive voltage and a negative voltage selected from a plurality of gradation voltages in accordance with the data are alternately applied to a display medium through each of a plurality of data lines, the driving circuit comprising a charging circuit for applying, regardless of the data, a voltage equal to or higher than a highest positive gradation voltage which has a highest level among levels of the plurality of gradation voltages to each data line for a predetermined period of time at the beginning of a scan period for applying a positive gradation voltage.

2. A driving circuit according to claim 1, wherein a power supply circuit for the highest positive gradation voltage works also as a power supply circuit for the charging means.

3. A driving circuit for a display apparatus having a gradation display operable by voltages applied in accordance with digital data in which a positive voltage and a negative voltage selected from a plurality of gradation voltages in accordance with the data are alternately applied to a display medium through each of a plurality of data lines, the driving circuit comprising a discharging circuit for applying, regardless of the data, a voltage equal to or lower than a lowest negative gradation voltage which has a lowest level among levels of the plurality of gradation voltages to each data line for a predetermined period of time at the beginning of a scan period for applying a negative gradation voltage.

4. A driving circuit according to claim 3, wherein a power supply circuit for the lowest negative gradation voltage works also as a power supply circuit for the discharging means.

5. A driving circuit for a display apparatus having a gradation display operable by voltages applied in accordance with digital data in which a positive voltage and a negative voltage selected from a plurality of gradation voltages in accordance with the data are alternately applied to a display medium through each of a plurality of data lines for each alternate frame, the driving circuit comprising a charging circuit for applying, regardless of the data, a voltage equal to or higher than a highest positive gradation voltage which has a highest level among levels of the plurality of gradation voltage to each data line for a predetermined period of time at the beginning of a horizontal scanning period.

6. A driving circuit according to claim 5, wherein a voltage equal to or higher than the highest positive gradation voltage is applied to each data line for the predetermined period in a positive frame, and a voltage equal to or higher than a highest negative gradation voltage which has a highest level among levels of the plurality of negative gradation voltages is applied to each data line for the predetermined period in a negative frame.

7. A driving circuit according to claim 5, wherein a power supply circuit for the highest positive gradation voltage works also as a power supply circuit for the charging means.

8. A driving circuit for a display apparatus having a gradation display operable by voltages applied in accordance with digital data in which a positive voltage and a negative voltage selected from a plurality of gradation voltages in accordance with the data are alternately applied to a display medium through each of a plurality of data lines for each alternate frame, the driving circuit comprising a discharging circuit for applying a voltage, regardless of the data, equal to or lower than a lowest positive gradation voltage which has a lowest level among levels of the plurality of gradation voltage to each data line for a predetermined period of time at the beginning of a horizontal scanning period.

9. A driving circuit according to claim 8, wherein a voltage equal to or lower than a lowest positive gradation voltage is applied to each data line for the predetermined period in a positive frame, and a voltage equal to or lower than the lowest negative gradation voltage which has a lowest level among levels of the plurality of gradation voltages is applied to each data line for the predetermined period in a negative frame.

10. A driving circuit according to claim 8, wherein a power supply circuit for the lowest negative gradation voltage works also as a power supply circuit for the discharging means.

* * * * *